US007537619B2

(12) United States Patent
Huard

(10) Patent No.: US 7,537,619 B2
(45) Date of Patent: May 26, 2009

(54) **METHOD AND SYSTEM FOR THE TREATMENT OF *BETULA* WOOD**

(75) Inventor: Michel Huard, Rimouski (CA)

(73) Assignee: Félix Huard Inc., Luceville, Québec (CA)

( * ) Notice: Subject to any disclaimer, the term of this patent is extended or adjusted under 35 U.S.C. 154(b) by 914 days.

(21) Appl. No.: 10/819,953

(22) Filed: Apr. 8, 2004

(65) Prior Publication Data

US 2005/0223591 A1 Oct. 13, 2005

(51) Int. Cl.
*B27K 3/06* (2006.01)

(52) U.S. Cl. ..... 8/402; 8/518; 8/149.3

(58) Field of Classification Search ..... 8/402, 8/518, 149.3
See application file for complete search history.

(56) References Cited

U.S. PATENT DOCUMENTS

| | | | | | |
|---|---|---|---|---|---|
| 1,396,899 | A | * | 11/1921 | Twombly et al. | 427/315 |
| 2,802,281 | A | * | 8/1957 | Stone | 34/73 |
| 3,448,530 | A | * | 6/1969 | Mortensen | 34/380 |
| 4,017,980 | A | | 4/1977 | Kleinguenther | |
| 4,233,752 | A | | 11/1980 | Kleinguenther | |
| 4,233,753 | A | * | 11/1980 | Olson | 34/405 |
| 4,343,095 | A | | 8/1982 | Rosen | |
| 4,416,069 | A | * | 11/1983 | Rosen et al. | 34/380 |
| 5,343,913 | A | | 9/1994 | Tanahashi | |
| 5,784,805 | A | | 7/1998 | Hashimoto | |
| 6,345,450 | B1 | | 2/2002 | Elder | |
| 6,667,429 | B2 | * | 12/2003 | Abe et al. | 84/1 |

FOREIGN PATENT DOCUMENTS

| | | |
|---|---|---|
| CA | 2232974 | 7/1997 |
| CA | 2337357 | 7/1999 |

OTHER PUBLICATIONS

U.S. Appl. No. 09/849,284, filed May 4, 2001, Leonovs.
U.S. Appl. No. 10/215,183, filed Aug. 9, 2002, Dedieu.

* cited by examiner

*Primary Examiner*—Lorna M Douyon
*Assistant Examiner*—Amina Khan
(74) *Attorney, Agent, or Firm*—Ogilvy Renault LLP

(57) ABSTRACT

A method and a system for treating *betula* wood to change the coloration thereof to resemble that of Cherry wood or heartwood of birch is described. The *betula* wood is introduced in treatment chamber which is under atmospheric pressure. Hot steam from a steam generator is introduced in the treatment chamber in a lower section thereof for subjecting the *betula* wood to be treated to a hot water vapor environment. The temperature and humidity levels in the treatment chamber are controlled over a time span until the *betula* wood is completely saturated with water and has obtained a desired color transformation. This color transformation is uniform throughout the thickness of the wood and thereby highlights the grain in the *betula* wood while at the same time changes its color whereby it resembles Cherry wood or heartwood of birch. The treated wood is then cooled in the treatment chamber and removed therefrom for further processing.

14 Claims, 3 Drawing Sheets

FIG.1
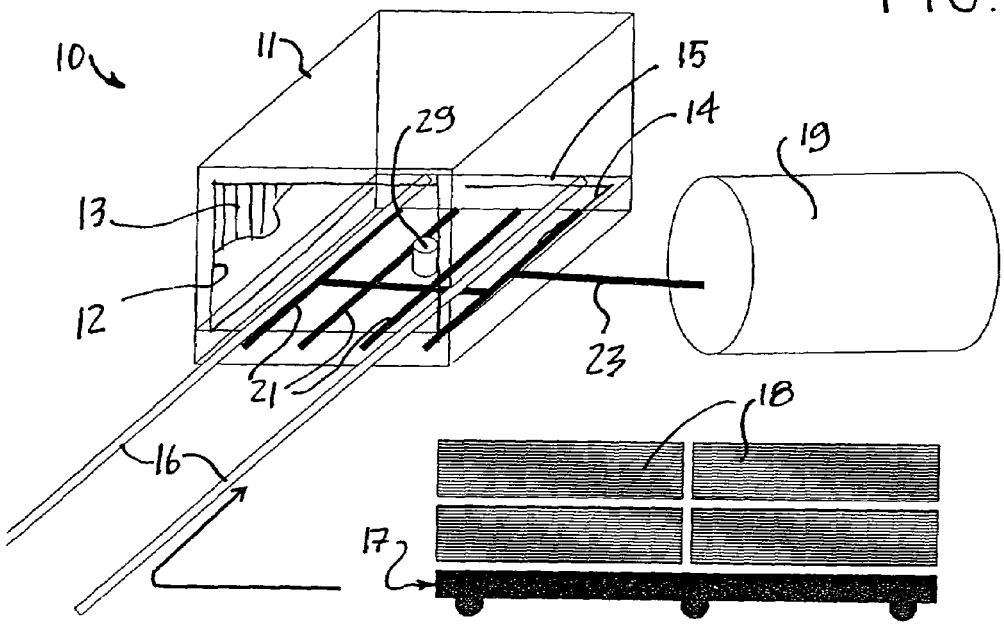
FIG.1A
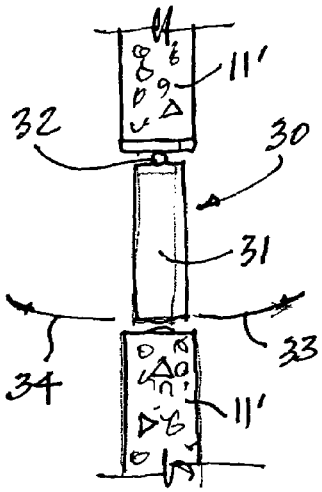
FIG.2A
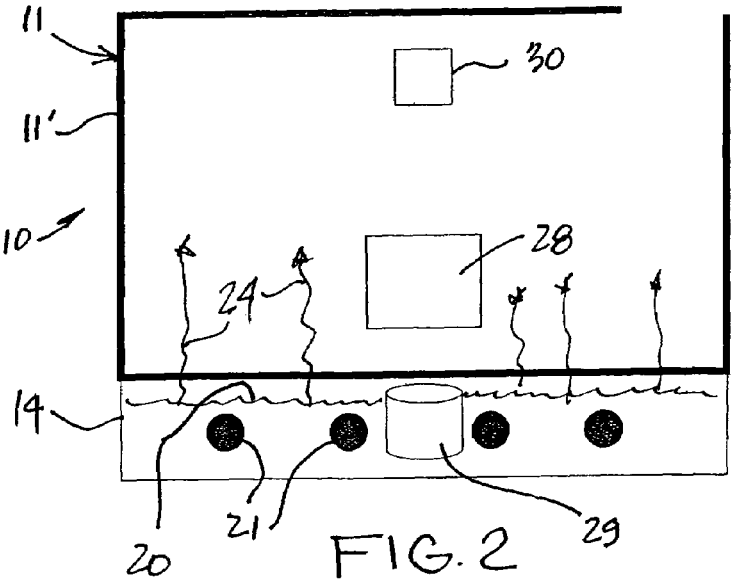
FIG.2

METHOD AND SYSTEM FOR THE TREATMENT OF *BETULA* WOOD

TECHNICAL FIELD

The present invention relates to a method and a system for the treatment of *betula* wood to change the coloration thereof whereby it resembles that of Cherry wood or heartwood of birch.

BACKGROUND ART

It is known to treat timber whereby to transform its appearance such that it resembles another type of wood. For example, U.S. Patent Application Publication 2002/0178608 A1, published on Dec. 5, 2002, describes a method and an apparatus for treating wood whereby it resembles Bog oak. The method is a chemical method which involves a sequence of steps under controlled conditions of time, temperature and pressure and in particular, a steam-air-ammonia composition is added to the timber. It can treat a wide variety of wood types to resemble Bog oak and depending on the specific type of wood used, the process is modified. The wood is treated under pressure within an appropriate vessel which is constructed for this treatment and the wood can be introduced therein in a dry or green state but is always treated with the ammonia composition. The aim of that process and apparatus is to change the quality of the treated timber to resemble Bog oak timber which is a higher quality timber. However, that system is quite expensive and is potentially not friendly to the environment. The timber is also treated in a reactor under pressure and ammonia is blown therein, which process could be hazardous to work personnel. Accordingly, many precautions need to be taken when this timber is manipulated in and out of the reactor. By using high and low pressures, there are risks of explosion and by using toxic products at high pressures the reactor must be constructed of expensive material, such as stainless steel. The process as described in this patent transforms in a radical fashion the properties of the treated timber, such as increasing the hardness of the timber whereby the planing and sawing thereof causes more wear-and-tear on machinery. The timber also is subjected to a change of its hygroscopic properties thereby requiring a different drying process. Accordingly, not only is the process more costly, but the processing of the treated timber provides an additional cost.

When drying wood at high temperature, such as *betula*, the object is to extract water from the wood as quickly as possible. Accordingly, the wood is dried under conditions that favour evaporation to reduce the humidity within the wood down to about 6% to 12% (percent). When *betula* is dried at high temperature, its coloration changes to the brownish tones, sort of a caramel color. This coloration change is not adding value to Birch wood and is mostly considered as a defect of drying. It is known that this drying process will cause great stress in the wood causing many drying defects such as checks, splits and loose knots.

SUMMARY OF INVENTION

The present invention concerns the treatment of *betula* wood to change its coloration thereof entirely through the thickness of the wood pieces that are treated.

It is a feature of the present invention to provide a method and system for the treatment of *betula* wood to change the coloration throughout the thickness of the wood to resemble that of Cherry wood or heartwood of birch, which is a reddish colored wood and wherein various tones of reddish coloration can be produced.

Another feature of the present invention is to provide a method and a system for the treatment of *betula* wood to change the coloration thereof and wherein such system is economic to construct and is not highly toxic and wherein the system operates under atmospheric pressure.

Another feature of the present invention is to provide a method and a system for the treatment of *betula* wood to change the coloration thereof and wherein no chemicals are used in the process and wherein other properties of the wood are not altered or significantly altered.

Another feature of the present invention is to provide a method and a system for treating *betula* wood to change the coloration throughout to resemble that of Cherry wood or heartwood of birch, which is a reddish-type wood and wherein the tone of such coloration can be controlled by modifying the temperature and treatment time.

Another feature of the present invention is to provide a method and a system for the treatment of *betula* wood to change the coloration throughout to resemble that of Cherry wood or heartwood of birch, and wherein during the method of treatment, the wood is not subjected to a drying stage but on the contrary to a humidifying hot treatment process and this allows for further peeling or slicing of the treated wood.

Another feature of the present invention is to provide a method and system for the treatment of *betula* wood whereby to change the coloration thereof and throughout to resemble that of Cherry wood or heartwood of birch, and wherein the wood can be treated in the form of timber pieces, boards or logs disposed in a large treatment chamber at atmospheric pressures and wherein large quantities of such wood can be treated at the same time without chemical additives.

According to the above features, from abroad aspect, the present invention provides a method of treatment of *betula* wood to change the coloration thereof to a desired color transformation, said method comprising the step of providing a treatment chamber having a water basin in a floor area thereof, said treatment chamber being maintained at atmospheric pressure during said treatment and having access means to introduce and position over said water basin *betula* wood having a humidity content of at least 25% in mass to be treated under atmospheric pressure in said treatment chamber, closing said access means, introducing steam from a steam generating means into said water basin to boil and agitate water therein for subjecting said *betula* wood to be treated to a hot water vapor environment to completely saturate the *betula* wood throughout the thickness thereof, controlling the supply of said steam to control the temperature and humidity levels in said treatment chamber over a time span until said *betula* wood. to be treated has obtained a desired color transformation throughout the thickness thereof, obtaining *betula* wood samples from said treatment chamber for a predetermined period of time not to expose said heated *betula* wood to an abrupt atmospheric change, removing said treated *betula* wood, fully impregnated with water vapors, after said predetermined period of time, and drying said *betula* wood in conventional dryers.

According to the above features, from a broad aspect, the present invention provides a system for the treatment of *betula* wood to change the coloration thereof to resemble that of Cherry wood or heartwood of birch, said system comprising a treatment chamber having a closable access means to position and remove *betula* wood to be treated therein, a steam generator for supplying steam to said treatment chamber at atmospheric pressure for subjecting said *betula* wood to be treated to a hot water vapor environment, control means for controlling temperature and humidity levels in said treatment chamber over a time span until said *betula* wood has been saturated with water throughout and obtained a desired color transformation which is uniform throughout the thickness thereof.

BRIEF DESCRIPTION OF DRAWINGS

A preferred embodiment of the present invention will now be described with reference to the accompanying drawings in which:

FIG. 1 is a schematic diagram illustrating the basic component parts of the treatment system;

FIG. 1A is a schematic illustration of a carriage displaceable on tracks and carrying *betula* wood boards for positioning same in and out of the treatment chamber over the water basin;

FIG. 2 is a further schematic diagram of the treatment chamber;

FIG. 2*a* is a schematic illustration of the valve trap as seen in cross-section;

DESCRIPTION OF PREFERRED EMBODIMENTS

Figure 3:
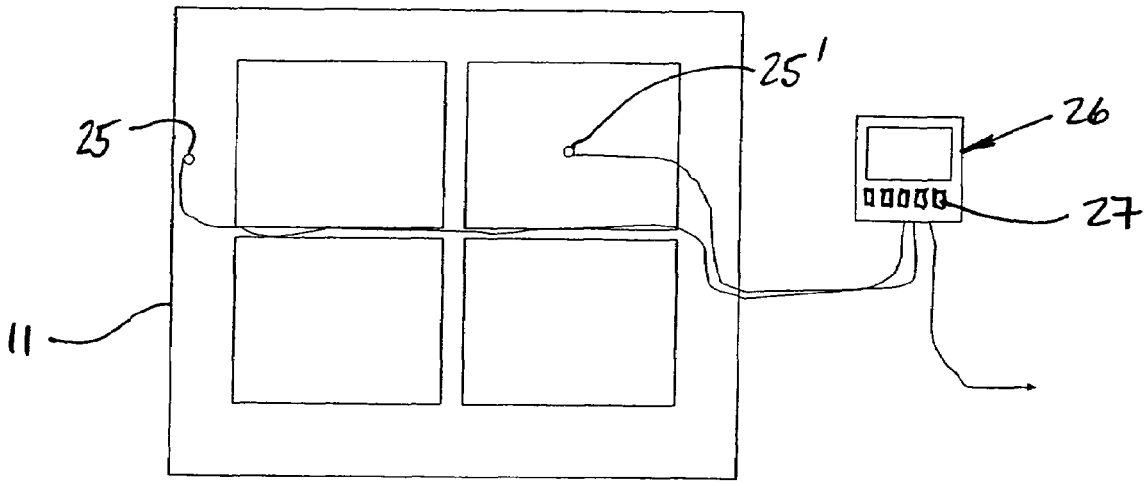
FIG. 3 is a still further schematic diagram of the treatment chamber.

Referring now to the drawings and more particularly to FIGS. 1 and 2, there is shown generally at 10 the basic component parts of the system for treating *betula* wood to change the coloration thereof whereby it resembles that of Cherry wood which is a reddish-tone wood which is usually utilized for the construction of floors or furniture pieces and kitchen cabinets. The specific types of birch treated by this process are "*betula alleghaniensis*" and "*betula papyrifera*" which are respectively known in the industry as Yellow Birch and White Birch. This wood is much cheaper than that of Cherry wood and is in ample quantities in the Northeast part of North America. By changing the coloration thereof to a reddish tone, this wood becomes more commercializable and it has properties that resemble closely that of Cherry wood once its color has been transformed. Cherry wood is less plentiful and expensive.

The treatment system as herein schematically illustrated consists of a treatment chamber 11 which is provided with a large door opening 12 in which there is displaceably positioned a thick insulated door 13. The treatment chamber 11 is a reinforced concrete structure having a water basin 14, also constructed of concrete, disposed in the floor 15 thereof. A pair of rail tracks 16 support a carriage 17 above the water basin 14. The carriage is loaded with *betula* timber 18 to be treated. As hereinshown, the track rails 16 extend across the water basin 14 whereby the carriage and the *betula* wood are entirely surrounded by the basin.

A steam generator 19, which is herein a gas-fired boiler, located exteriorly of the structure 11, supplies hot steam into the water 20 contained within the water basin 14. This is done by disposing a plurality of perforated distribution conduits 21 adjacent the bottom wall 22 of the water basin 14, as illustrated in FIG. 2, and feeding hot steam in the basin through the conduits 21 which are connected to a supply conduit 23 which connects to the boiler. This hot steam released within the water 20 causes the water to boil and releases hot water vapors 24 within the chamber 11 whereby to completely saturate the chamber and the *betula* with hot water vapors. Accordingly, the stacks of *betula* timber 18 disposed over the water basin become saturated with hot water vapors throughout its thickness.

As shown in FIG. 3, thermal sensors 25 and 25', only two shown herein but a plurality of these could be disposed within the treatment chamber, provide temperature information signals to a controller device 26 whereby to monitor the temperature within the chamber. Because the temperature within the chamber is produced by the hot water vapors released from the water basin, it is possible to control the temperature by controlling the amount of hot steam supplied to the distribution conduits 21 by the boiler. Accordingly, by controlling the boiler, we can control the heat within the chamber, which chamber always remains completely saturated with hot water vapors. Therefore, by monitoring temperature we also monitor the humidity level within the chamber.

The controller device 26 is a computerized device and it is provided with an interface comprised of switches and dials 27 whereby an operator can interface with the computer to set the parameters thereof depending on the condition of the *betula* wood that is placed within the chamber and the computer controls the boiler. The *betula* wood is treated during a predetermined time span until a desired color transformation has been obtained. To verify the color transformation during the processing time, there is provided a trap door 28 in a wall of the treatment chamber 11 to provide access into the chamber to extract sample wood pieces which can then be cut and planed to verify the extent of the color transformation on the surface and throughout the thickness of the treated *betula* wood.

A displaceable valve element 30 is provided either in the insulated door 13 or in a wall of the treatment chamber 11, as shown in FIG. 2, to communicate the inside atmosphere within the treatment chamber with outside atmosphere. This valve element is in the form of a hinge door 31 suspended on a top hinge 32 and capable of swinging out of the chamber or into the chamber as indicated by arrows 33 and 34, respectively. Accordingly, if excessive steam pressure builds up within the chamber, the door 31 will swing outwardly in the direction of arrow 33 and release steam from the chamber when the chamber is at full vapor capacity. During the cooling cycle of the process, when water vapors are diminishing and or cooling, it will permit the influx of air into the chamber to avoid implosion.

Although in FIG. 1 there is shown a pair of track rails entering the chamber through a single door, it is to be understood that a door could be provided at both ends of a treatment chamber and that two or more carriages 17 may be supported on the tracks. When a carriage is positioned in the chamber to treat the *betula*, another one is being loaded with stacks of *betula* timber in a stand-by position outside one of the doors. The treated *betula* then exits the other door for further processing while the stand-by carriage is then disposed within the chamber. This type of arrangement permits the treatment process to be more efficient as there is very little time loss between the removal of a treated *betula* wood from the treatment chamber and the repositioning of a further load of *betula* timber to be treated. It is also pointed out that the stacks of *betula* timber may consist of boards which are disposed in facial contact with one another. It is not necessary for the treatment to separate the boards in sheet form with slats, as the wood becomes completely saturated with the hot water vapor during treatment.

Figure 4A:
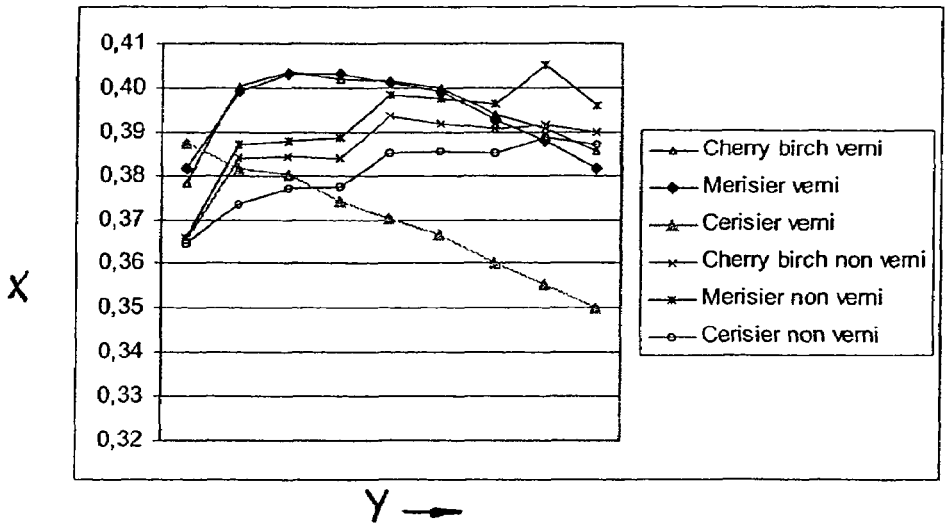
FIG. 4A is a graph showing comparative curves of coloration measurement between treated *betula* and Cherry wood and heartwood of birch over a simulated time span with the wood pieces having been varnished and non-varnished.

Referring now to the graph illustration in FIG. 4A, there is illustrated *betula* treated in accordance with the present invention (herein identified as "Cherry Birch"), both in a varnish and a non-varnish form, and compared to heartwood of birch (also called Red Birch) and to Red Cherry wood, also varnished and non-varnished. It can be seen that the coloration along the x-axis of these samples is substantially different. The transformation of the coloration of these samples during an aging test shows that during aging of these wood products, represented by the y-axis, that there is a significant difference in the coloration change between the varnish and non-varnish samples. In fact, the varnish Red Cherry wood sample is the wood essence that undergoes a more radical color transformation with time.

Figure 4B:
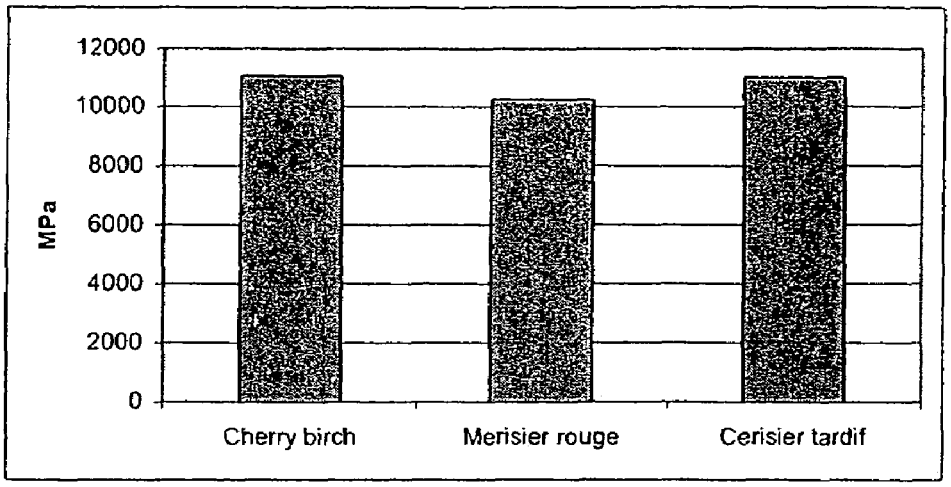
FIG. 4B is a further graph illustrating the comparative hardness between the sample board pieces of FIG. 4A.

The *betula* sample treated in accordance with the present invention was also measured as to its hardness with these samples and the results of this measurement are illustrated in FIG. 4B. The analysis of these samples is done by a well known test program of SAS Statistics and it shows that there is not much difference between the hardness of these wood products. The result shows that the hardness is substantially the same regardless if the wood is varnished or not.

Figure 4C:
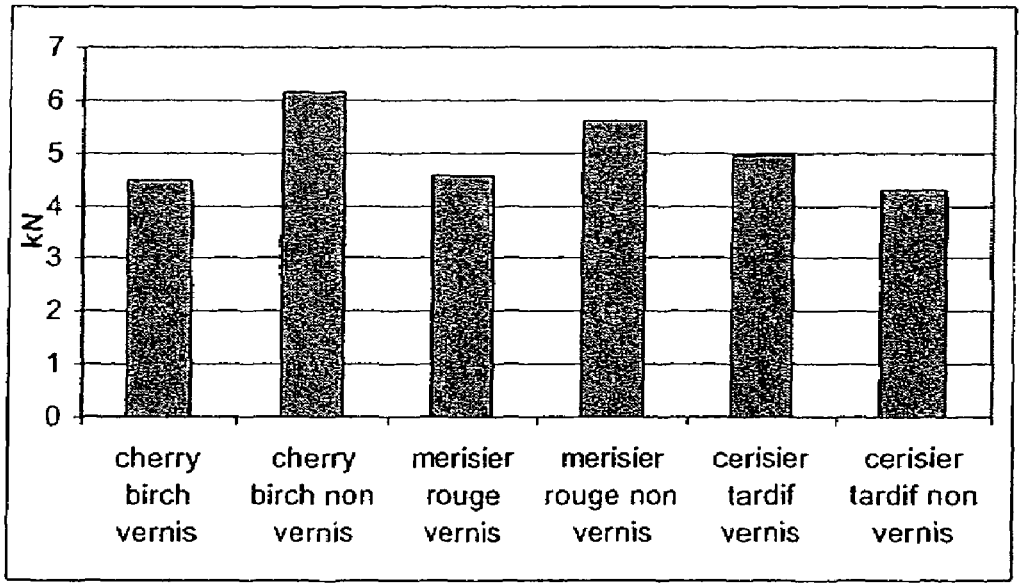
FIG. 4C is a further graph showing the modulus of elasticity between the three board samples.

FIG. 4C illustrates the modulus of elasticity of the tested samples. The average value obtained for each of these samples illustrates that the flexibility of the compared timbers is substantially equivalent.

The method of treatment of the *betula* wood is now summarized. *betula* wood is loaded on the carriage 17 and is disposed in the treatment chamber 11 over the water basin 14 and the entry door 13 is closed. Hot steam is then supplied to the water basin 14 to heat the water. Hot water vapors are released from the water either by boiling the water or from the hot steam injected in the water, whereby to saturate the *betula* wood with hot water vapor and fills the entire treatment chamber. The treatment goes on for several hours and the wood is saturated throughout its thickness. The temperature and humidity levels in the treatment chamber are controlled by a controller device which may be entirely computer-controlled or could interface with an operator. The computer device controls the boiler 19 which supplies the hot vapors into the water basin and by controlling the supply of vapor we can control the temperature and the humidity in the chamber.

It is pointed out that with this treatment, the *betula* coloration can be controlled from a light pinkish tint down to a dark reddish brown color whereby to produce wooden boards resembling various tones of Cherry wood. This control of the coloration is achieved by sampling lumber pieces being treated during the treatment process and analyzing the coloration change thereof.

The water level in the water basin is automatically controlled by the use of an overflow pipe 29. Steam will condense in the treatment chamber into the basin 14 to be evacuated through the overflow drain.

Depending on the nature of the *betula* wood placed in the treatment chamber, that is to say in the form of stacked boards with the boards having a certain thickness or in the form of large timber pieces or logs, the treatment time will vary. Also, the amount of humidity contained within the *betula* material when introduced in the chamber will affect the treatment time. It is pointed out that the *betula* wood before entering the treatment chamber preferably has a humidity content of at least 30%. If the *betula* wood has undergone natural drying by being exposed to outside atmosphere in warm climatic conditions, then before its treatment in the treatment chamber, it undergoes a water spray treatment whereby it absorbs humidity. It is pointed out that the humidity level in the treatment chamber 11 is maintained above 80% and preferably above 90%. Also, the desired temperature maintained within the treatment chamber should be above 140° F. and can attain up to about 200° F. to 220° F.

The computer automatically controls the boiler to maintain a substantially constant temperature within the treatment chamber. By maintaining such a temperature, the humidity level is assured as water vapors are continuously released from the hot water in the water basin. However, the agitation of the water and the amount of humidity released is a function of the amount of steam and temperature of the steam released through the distribution conduits 21 and this controls the temperature and humidity within the treatment chamber. The pressure within the treatment chamber is at substantially atmospheric pressure and in the range of about 90 to 110 kPa.

As previously described, a gate valve 30 is automatically operated to release steam from the chamber during the treatment process when there is too much pressure within the chamber and to admit outside air therein during the cooling cycle. After the wood has been adequately treated to achieve a desired coloration change, the steam supply is cut off and the cooling step begins. The treatment time takes approximately between 12 hours and 100 hours, and the cooling cycle time is usually a few hours whereby the *betula* wood is not exposed to an abrupt atmospheric change wherein evaporation would take place extremely quickly and the consequence thereof would produce hyper dehydration in the surfaces of the *betula* wood pieces and this would cause secondary problems in the drying stage when the lumber is disposed in conventional dryers. Usually the treated *betula* will sit in the treatment chamber for a few hours before being brought out and during these few hours the temperature and humidity in the chamber slowly diminish. Because the *betula* is fully impregnated with water vapors, it will take a few more hours to dry the timber in conventional dryers.

It is within the ambit of the present invention to cover any obvious modifications of the preferred embodiment described herein, provided such modifications fall within the scope of the appended claims.

The invention claimed is:

1. A method of treatment of *betula* wood to change the coloration thereof to a desired color transformation, said method comprising the step of:

i) providing a treatment chamber having a water basin in a floor area thereof, said treatment chamber being maintained at atmospheric pressure during said treatment and having access means to introduce and position over said water basin *betula* wood having a humidity content of at least 25% in mass to be treated under atmospheric pressure in said treatment chamber, ii) closing said access means, iii) introducing steam from a steam generating means into said water basin to boil and agitate water therein for subjecting said *betula* wood to be treated to a hot water vapor environment to completely saturate the *betula* wood throughout the thickness thereof, iv) controlling the supply of said steam to control the temperature and humidity levels in said treatment chamber over a time span until said *betula* wood to be treated has obtained a desired color transformation throughout the thickness thereof, v) obtaining *betula* wood samples from said treatment chamber during said time span of said treatment to monitor the change in coloration of said samples until said desired color transformation is obtained, vi) cooling said treatment chamber for a predetermined period of time not to expose said heated *betula* wood to an abrupt atmospheric change, vii) removing said treated *betula* wood, fully impregnated with water vapors, after said predetermined period of time for further processing, and viii) drying said *betula* wood in conventional dryers.

2. A method as claimed in claim 1, wherein there is further provided the step of controlling the water level in said water basin.

3. A method as claimed in claim 1, wherein said step (iv) comprises monitoring ambient temperature and humidity in said treatment chamber by sensing means, providing information signals to a controller device, and controlling the operation of said steam generating means as a function of temperature requirements.

4. A method as claimed in claim 1, wherein said steam is introduced in said water basin at a rate sufficient to release water vapors to completely propagate throughout said chamber to uniformly heat said chamber and penetrate said *betula* wood to be treated.

5. A method as claimed in claim 4, wherein there is further provided the step providing steam release valve means to regulate said vapor pressure inside said treatment chamber by releasing vapor when said chamber is above atmospheric pressure and permitting the influx of air during said cooling step (v) to prevent implosion of the treatment chamber.

6. A method as claimed in claim 1, wherein said *betula* wood to be treated is maintained, humid by spraying water thereon or soaking said wood into water or processing said wood rapidly after sawing logs or coating wood with plastic or wax or by any means necessary to prevent said wood from drying to assure that said *betula* wood has at least a humidity content of 25%.

7. A method as claimed in claim 4, wherein said humidity level in said treatment chamber is automatically regulated due to continuous release of hot water vapor in said chamber, said humidity level being. maintained above 80% and preferably about 97% to 99.99%.

8. A method as claimed in claim 3, wherein a desired temperature is maintained substantially constant in said treatment chamber by controlling the quantity of hot vapor released within said treatment chamber.

9. A method as claimed in claim 8, wherein said desired temperature is above 140° F. and preferably 200° F.

10. A method as claimed in claim 1, wherein said time span is a function of said desired color transformation, the ambient temperature and humidity content of said *betula* wood to be treated, the capacity of said steam generating means and heat loss from said treatment chamber to outside air.

11. A method as claimed in claim 1, wherein after said step (v) and before said step (vi) there is provided the step of stopping said introduction of steam into the chamber to slowly diminish heat add humidity from said treatment and maintaining said *betula* wood in said treatment chamber for a further period of time before subjecting same to exterior weather conditions to prevent abrupt evaporation from said *betula* wood impregnated with hot humidity.

12. A method as claimed in claim 11, wherein said further processing comprises slicing or peeling, sawing or cutting, planning or/and drying said *betula* wood impregnated with hot humidity in wood dryers.

13. A method as claimed in claim 1, wherein said atmospheric pressure in said treatment chamber is between 90 and 110 kPa.

14. A method as claimed in claim 1, wherein said *betula* wood to be treated is disposed in said treatment chamber as a stack of wood boards placed in facial contact, said time span being at least a 12 hour span.

* * * * *